United States Patent [19]

Greiner et al.

[11] Patent Number: 4,618,135

[45] Date of Patent: Oct. 21, 1986

[54] SHEET FEEDER PARTICULARLY FOR PRINTING PRESSES

[75] Inventors: Harry Greiner; Adolf Schwebel, both of Offenbach am Main, Fed. Rep. of Germany

[73] Assignee: MABEG Maschinenbau GmbH & Company, Fed. Rep. of Germany

[21] Appl. No.: 692,688

[22] Filed: Jan. 18, 1985

[30] Foreign Application Priority Data

Jan. 19, 1984 [DE] Fed. Rep. of Germany ..... 3401724

[51] Int. Cl.[4] ..... B65H 5/24

[52] U.S. Cl. ..... 271/9; 271/10; 271/264; 271/151

[58] Field of Search ..... 271/9, 10, 90, 264, 271/149, 151; 221/34, 92; 270/56

[56] References Cited

U.S. PATENT DOCUMENTS

| | | | |
|---|---|---|---|
| Re. 29,105 | 1/1977 | Miaskoff et al. | 271/9 X |
| 3,966,192 | 6/1976 | Jeschke | 271/30.1 X |
| 4,417,282 | 11/1983 | Yamamoto | 271/9 X |

FOREIGN PATENT DOCUMENTS

| | | | |
|---|---|---|---|
| 2724832 | 12/1978 | Fed. Rep. of Germany | 271/10 |
| 0113041 | 6/1966 | Netherlands | 271/9 |
| 0550315 | 1/1943 | United Kingdom | 271/30.1 |
| 2124416 | 2/1984 | United Kingdom | 271/10 |

*Primary Examiner*—Bruce H. Stoner, Jr.
*Assistant Examiner*—Lawrence J. Goffney, Jr.
*Attorney, Agent, or Firm*—Leydig, Voit & Mayer, Ltd.

[57] ABSTRACT

The invention relates to a sheet feeder for the individual feeding of sheets to a sheet treating machine. A first sheet pile is carried by a main pile table, and sheets from this sheet pile can be fed by a sheet separating device, optionally via a first feed table, to the sheet treating machine. A further sheet pile is carried by an auxiliary pile table. Sheets can be fed by a second sheet separating device from this further sheet pile to the sheet treating machine, again optionally via a second feed table. Using this arrangement, in place of the sheets from the first pile table, sheets from the auxiliary pile table can be fed to the sheet treating machine without interruption, as the sheet feed from the two piles is carried out in the same rhythm. Preferably a control circuit is used to meter out a selected number of prerun sheets from the auxiliary pile table followed without interruption by another selected number of continuous running sheets.

19 Claims, 2 Drawing Figures

SHEET FEEDER PARTICULARLY FOR PRINTING PRESSES

BACKGROUND OF THE INVENTION

This invention relates to a sheet feeder for individually feeding sheets to a sheet treating machine, for example, a printing press, wherein a first sheet pile is carried by a main pile table and the respective uppermost sheet of the first sheet pile is feedable from a first sheet separting device, if desired via a first feed table, to the sheet treating machine, and with an auxiliary pile table carrying a second pile of sheets, of which the respective uppermost sheets are feedable by a second sheet separation device, if desired via a second feed table, to the sheet treating machine in place of the sheets from the main pile table.

In the case of such sheet feeders it is known to feed sheets to the sheet treating machine either from the first or from the second sheet pile.

On a change of the sheet feed from the one sheet pile to the other sheet pile, there comes a substantial interruption of operation, which is necessary for the changeover procedure.

SUMMARY OF THE INVENTION

The primary object of the invention is to provide a sheet feeder of the above general type which has small constructional volume and small floor space requirements and can be changed over in a short time from a sheet feed from the main pile table to the auxiliary pile table and vice versa.

Another object of the invention is to provide a sheet feeder that can feed a continuous lapped stream of sheets including a first preselected number of sheets from an auxiliary pile table.

In accordance with the primary aspect of the invention, the sheets of the main pile board and of the auxiliary pile board can be fed in the same rhythm to the sheet treating machine, whereby on a change of the sheet feed from the one to the other sheet pile, the sheet stream, from which the sheet feeding takes place, can be interrupted, and the sheet stream from the sheet pile to which the change is effected can be started in such a way that the sheet feed to the sheet treating machine is without interruption.

By employing this feature of the invention, one has only to change from one sheet separating device to the other sheet separating device and if necessary from one to the other feed table in order to be able to work continuously, without adjustment work and without interruption of the work.

With single sheet feeding one can go in simple fashion from a used up pile on the main pile table to the sheet feed from the auxilliary pile table, and without interruption fill the pile table with a new pile of sheets.

Also it is possible without interruption, for example, first to feed from the auxiliary pile table prerun sheets to the sheet treating machine, and then change over to the feed of continuous run sheets from the main pile table. This is particularly advantageous if the sheet treating machine is a printing press, particularly a high speed sheet-fed offset printing press. Such a change from the auxiliary pile table to the main pile table is just as advantageously possible with overlapped stream sheet feeding. Changeover on the fly without interruption is also possible in an advantageous fashion if the sheet feed takes place with an underlapped feed of sheets wherein the first sheet of the lapped stream of sheets of the first sheet pile can be slid under the last sheet of the lapped stream of sheets from the second sheet pile, with exact timing.

If the number of the sheets of the sheet stream up to a change from the sheets of the auxiliary pile table to the sheets of the main pile table and vice versa can be adjusted by a preselection device, then the operational running with change of the sheet feeding can run wholly automatically. This is particularly favorable if, for example, first a particular number of prerun sheets are to be taken from the auxiliary pile table and then continuously printed sheets are to be fed from the main pile table to a printing press. The preselection device can be a preselecting counter of an electrical or electronic operation control circuit for the sheet feeder.

For exactly timed operation a mechanical drive connection can be made between the sheet treating machine and the first sheet separating device as well as, if desired, the first feed table.

If a second mechanical drive connection can also be made between the first and the second separating devices and, if desired, between the first and the second feed tables, then there takes place in simple fashion also an exactly timed working on changing the sheet feed.

In order to prevent the second drive connection from being changed when the first drive connection is disengaged, the first and second drive connections can be made simultaneously in response to a common part of the operation control circuit. Simple, certain operation is thereby achieved, in that the operational running of the sheet feeder can be switched in by one switch of the operation control circuit.

The mechanical drive connection can preferably be switched off between the first and the second separating devices and, if appropriate, the first and the second feed tables, after the feed of the last of the preset number of sheets to the sheet treating machine.

In order to make it possible that, for example, after the feeding of prerun sheets from the auxiliary pile table a definite number of good sheets can directly thereafter be called for, to follow in the sheet run of the prerun sheets, the operation control circuit can have a second adjustable preselection device by which the number of sheets of the sheet stream after a change from the sheets of the main pile table to the sheets of the auxiliary pile table and vice versa can be adjusted. In this connection the preselection device is preferably a preselecting counter. For offset printing, for example, the prerun sheets from the auxiliary pile table are used to establish equilibrium inking and dampening conditions for the production sheets from the main pile table. Therefore, by using the present invention, it may be possible to use less expensive or visually distinct paper for the prerun sheets in which case the prerun sheets are easily introduced at the feeder and sorted out after printing.

No additional floor area and only little additional constructional space is necessary compared with customary sheet feeders if the main pile table and auxiliary pile table are arranged fixed one over the other and if the first and second feed tables are arranged one over the other.

In this connection a transfer of the sheets to the sheet treating machine takes place in simple fashion in that the ends of the first and second feed tables adjacent to the sheet treating machine are arranged in essentially the same run-in position with respect to the sheet treating machine. This is made possible without substantial difficulty by spacing these ends of the first and second feed tables by a slightly greater distance one above the other than the thickness of a sheet or the thickness of a lapped sheet stream.

If the end of the upper feed table towards the sheet treating machine can be swung away from the lower feed table, then after a change of the sheet feed from the second feed table to the first feed table, the second feed table can be swung away, which gives good accessibility, and the operability of the sheet feeder, as with customary sheet feeders, is maintained.

For wholly automatic operational running, the main pile table and/or the auxiliary pile table can be raised and lowered by means of electric motors in response to sensors to maintain the level of the respective uppermost sheet of the first or second sheet pile constant.

The first and/or second sheet separation device can have a suction head, in each case grasping the respective upper sheet and moving it in the feed direction. For avoidance of interruptions or jamming arising from the feed of multiple sheets to the sheet treating machine there can be arranged in the transport region of the first and/or second feed tables a multiple sheet checking device.

BRIEF DESCRIPTION OF THE DRAWINGS

Other objects and advantages of the invention will become apparent upon reading the following detailed description and upon reference to the drawings in which.

Figure 1:
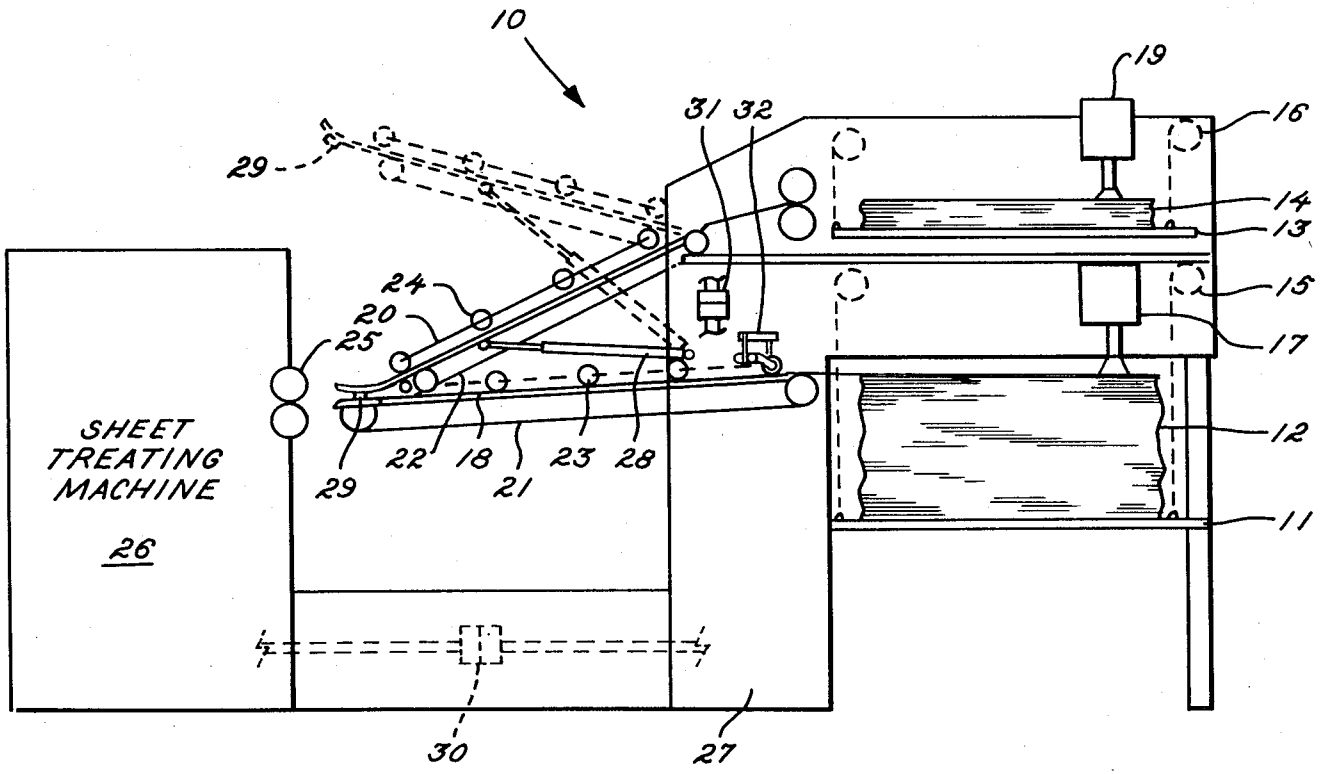
FIG. 1 is a side view of a sheet feeder illustrating the invention.

While the invention is susceptible to various modifications and alternative forms, a specific embodiment thereof has been shown by way of example in the drawings and herein will be described in detail. It should be understood, however, that it is not intended to limit the invention to the particular form disclosed, but on the contrary, the intention is to cover all modifications, equivalents and alternatives falling within the spirit and scope of the invention as defined by the appended claims.

DESCRIPTION OF THE PREFERRED EMBODIMENT

Turning now to the drawings, there is shown in FIG. 1 a sheet feeder generally designated 10 incorporating features of the present invention. The sheet feeder 10 has a main pile table 11 for carrying a first sheet pile 12. Arranged over the main pile table 11 is an auxiliary pile table 13 for carrying a second sheet pile 14. Both the main pile table 11 and also the auxiliary pile table 13 are in each case provided with a conventional electric motor raising device 15 and 16, which adjusts the height of the respective pile table 11, 13 in response to sensing of the respective upper sheets of the first or second sheet piles 12 or 14 respectively to insure that the upper sheets are always located at the same respective height. A conventional suction head 17 serves for loosening, separating and feeding the respective uppermost sheet of the first sheet pile 12 to a first feed table 18. In the same way a suction head 19 serves for loosening, separating and feeding the respective uppermost sheets of the second sheet pile 14 to a second feed table 20.

Both feed tables 18 and 19 are provided with conventional feed conveyors 21 and 22 as well as hold down rollers 23 and 24 for transferring separated sheets to pull-off rollers 25 of a sheet treating machine 26 such as a printing press.

The second feed table 20 is pivotally mounted, at its upstream end adjacent the auxiliary pile 14, on a common framework 27 for the main pile table 11 and the auxiliary pile table 13. Accordingly, the second feed table 20 can be swung away from the first feed table 18. In its swung away position, shown in dashed lines, the second feed table 20 is held by a telescopic support 28 linked at one end to the framework 27 and with its other end to the feed table 20.

In the operation position of the second feed table 20, drawn in continuous lines, the down-stream or transfer ends of feed table 18 and feed table 20 lie one over the other at a distance of only a little more than the height of a lapped stream of sheets to be fed, and both end in a transfer position relative to the pull-off rollers 25 of the sheet treating machine 26. In this connection the second feed table 20 rests on the first feed table 18 via distance pieces 29 fixed at its edges. Because of the defined distance between the transfer ends of the feed tables 18 and 20, without swinging away the second feed table 20 an overlapped stream feed of sheets can be fed to the feed table 18 underneath the feed table 20 and through to the pull-off rollers 25.

The sheet feeder illustrated serves preferably for the feeding of sheets as a lapped stream. In this connection first prerun sheets are fed from the second sheet pile 14 and then subsequent running sheets are fed from the first sheet pile 12. By a mechanical drive connection 30 between the sheet treating machine 26, the suction head 17 and the feed table 18, as well as by a mechanical drive connection 31 between the suction head 17 and the suction head 19, exactly synchronized or timed operational running of the sheet feeder 10 with respect to the sheet treating machine 26 is ensured regardless of whether sheets are fed from the first or second sheet piles 12 or 14. The mechanical drive connections, for example, include single tooth clutches of well-known construction which always engage at a particular phase relationship between their input and output connections.

Preferably the feeding of sheets may be stopped in response to a shut-down signal, for example, generated by a multiple sheet and missing sheet checking device 32 placed in the transport region of the first feed table 21. A multiple and missing sheet checking device may also be placed in the transport region of the second feed table 20. The preferred multiple and missing sheet checking device is further disclosed in Kistner, U.S. Pat. No. 4,420,747, issued Dec. 13, 1983.

Figure 2:
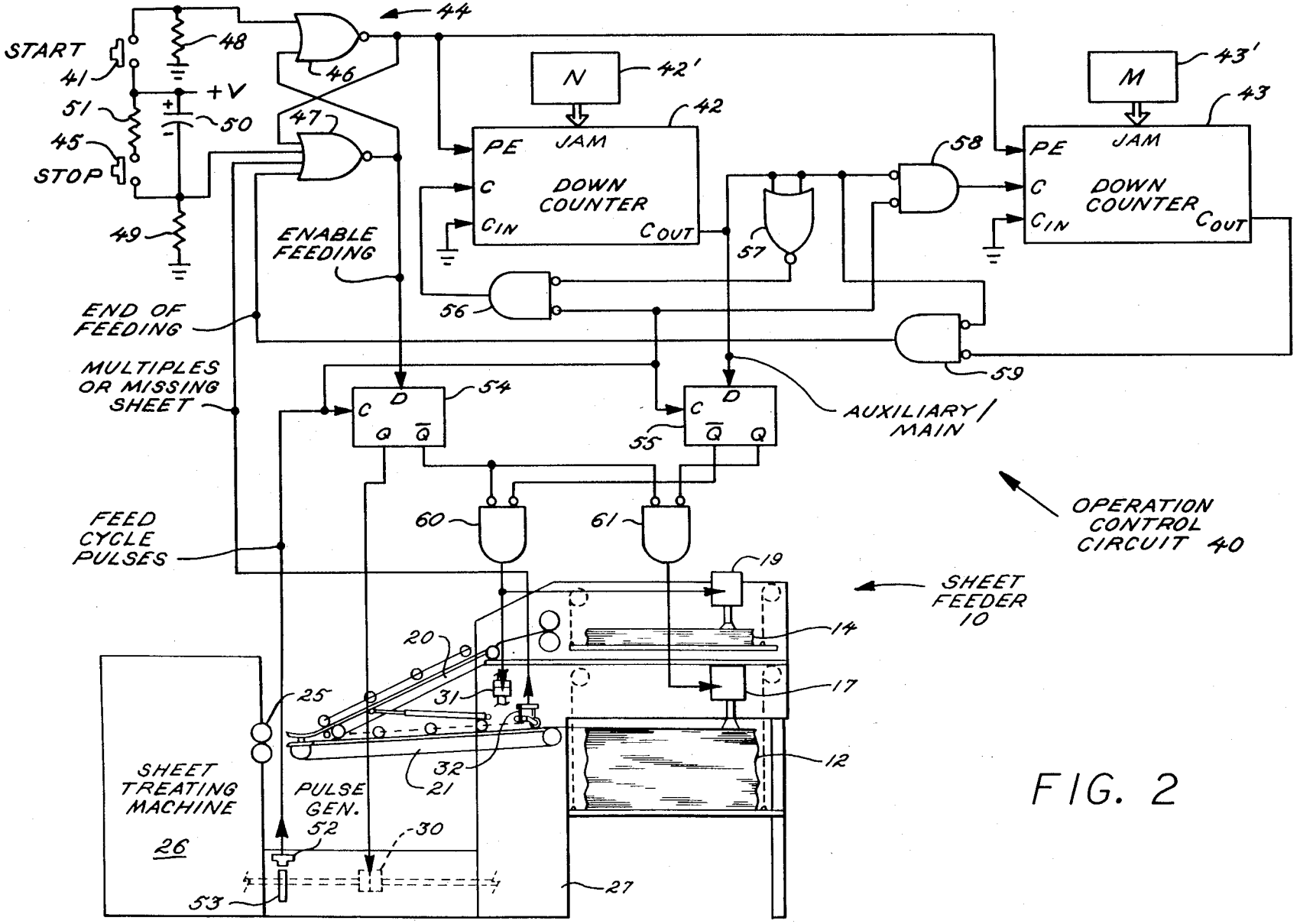
FIG. 2 is a schematic diagram of a control arrangement for enabling the sheet feeder of FIG. 1 to feed preselected numbers of prerunning and continuously printed sheets as a lapped stream.

Preferably the start-up of the sheet delivery takes place in response to an operation control circuit such as the circuit generally designated 40 shown in FIG. 2.

In response to a START signal at a push-button switch 41, both of the mechanical drive connections 30 and 31 are engaged. A selected number N of prerun sheets are registered by a prerun counter 42 in the control circuit 40 and are fed from the auxiliary sheet pile 14 via the feed table 20 to the pull-off rollers 25.

By means of the control circuit 40 then at a timing distance corresponding to the number of prerun sheets set on the prerun counter 42, the suction head 17 is put into action in such a way that the first full running sheet of the main sheet pile 12 on reaching the down-stream or transfer end of the feed tables 18 and 20 underlaps the last prerunning sheet. Since the rear end of the last prerunning sheet is held up by the transfer end of the feed table 20, the front end of the first continuous running sheet can underlap the prerunning sheets in such a way that an uninterrupted lapped stream with a constant lapping distance is fed to the pull-off rollers 25.

The mechanical drive connection 31 between the suction heads 17 and 19 is now separated so that only suction head 17 is in operation.

By means of a second preselection counter 43 the control circuit 40 can have a number M of continuous run sheets to be fed from the main sheet pile 2 selected so that the sheet feeder 10, after feeding this number M of continuous run sheets, is stopped.

Turning now to the details of the operation control circuit 40, an ENABLE FEEDING signal is generated by a set-reset flip-flop generally designated 44 responsive to the START push-button switch 41 and a STOP push-button switch 45. The set-reset flip-flop 44 includes a two-input NOR-gate 46 receiving a signal from the START switch 41, and a four-input NOR-gate 47 receiving a signal from the STOP switch 45. Pull-down resistors 48 and 49 provide the required normally low logic levels from the switches 41 and 45 which are excited by the positive supply voltage +V. A capacitor 50 and discharge limiting resistor 51 provide a power-on-reset condition. Resistors 48 and 49 are, for example 47 K ohms, resistor 51 is 470 ohms, and capacitor 50 is 10 microfarads. NOR-gate 46 is, for example, CMOS standard part number 4001, and NOR-gate 47 is CMOS standard part number 4002.

In order to shut off the sheet feeder 10 after the number M of sheets have been fed from the main pile 12, the NOR-gate 47 receives an END OF FEEDING signal. The feeder 10 is also shut off in the event of a MULTIPLES OR MISSING SHEET signal fed from the multiples checking device 32 to the NOR-gate 47.

The signal from the NOR-gate 46 is fed to preset enable (PE) inputs of the preselection counters 42 and 43 so that the counters are programmed with the selected numbers of counts N and M, respectively, whenever feeding of sheets is stopped by the set-reset flip-flop 44. The counters 42 and 43 each comprise a number of CMOS presettable up/down counters, standard part number 4029, wired for counting down (up/down input on pin 10 of the DIP package, not shown, being grounded). The JAM inputs to the counters receive the selected numbers of counts N, M from input devices 42', 43' such as binary-coded-decimal thumbwheel switches. The counters 42, 43 are selectively clocked or decremented in response to feed cycle pulses from a pulse generator responsive to a timing mark or disc 53 affixed to the sheet treating machine drive to the mechanical connection or clutch 30 between the sheet treating machine 26 and the sheet feeder 10. In other words, the pulse generator 52 generates a pulse at the beginning of each sheet feed cycle. The rising edge of the pulse clocks synchronizing delay flip-flops 54, 55 for sampling an ENABLE FEEDING signal from the set-reset flip-flop 44 and an AUXILIARY/MAIN signal from the counter 42. The delay flip-flops 54, 55 are CMOS standard part number 4013. The falling edge of the pulse selectively decrements one of the counters 42 and 43 when the sheet feeder is enabled.

So that the prerun counter starts counting when feeding is enabled and counts down from N to zero and stops, the clock input (C) of the counter 42 is activated by a two-input NOR-gate 56 receiving the feed cycle pulses and being inhibited by a carry-out ($C_{OUT}$) from the counter 42. Since the carry-out is active low, an inverter 57 is connected between the carry-out ($C_{OUT}$) and the NOR-gate 56. The carry-out ($C_{OUT}$) from the counter 42 provides the AUXILIARY/MAIN signal which is a logic high (+V) for N counts after feeding is enabled and a logic 1 on thereafter.

A two-input NOR-gate 58 selectively applies the feed cycle pulses to the clock input (C) of the second counter 43 in response to the carry-out ($C_{OUT}$) from the prerun counter 42 being active low. therefore, the second counter 43 counts M sheet feed cycles only after the prerun counter 42 has finished counting N prerun sheet feed cycles. Another two-input NOR-gate 59 generates the END OF FEEDING signal when the carry-out signals ($C_{OUT}$) from both of the counters 42, 43 are active low.

A NOR-gate 60 activates the mechanical connection or clutch 31 providing mechanical drive to the auxiliary suction head 19, as well as suction to the auxiliary sucker 19, only when the synchronized ENABLE FEEDING and AUXILIARY/MAIN signals are active high. A NOR-gate 61 activates suction to the main sucker 17 only when the synchronized ENABLE FEEDING signal is active high and the AUXILIARY/MAIN signal is active low.

As is evident from the above detailed description, the sheet feeder 10 and associated operation control circuit 40 provide a compact and easily operated system for running a selected number of prerun sheets followed without interruption by a selected number of continuous running sheets. Therefore, the system is especially suited for running relatively small jobs where it is important to meter out a suitable number of continuous running sheets, and is also useful for segregating and metering the prerun sheets at the start of a printing job. For a large job, the number M is easily set to its maximum value so that, if desired, the entire main sheet pile 12 is fed. Thereafter, feeding from the auxiliary sheet pile 14 can be restarted while the main sheet pile 12 is refilled with new sheets.

What is claimed is:

1. A sheet feeder for the individual feeding of sheets to a sheet treating machine having a first sheet pile carried by a main pile table, a first sheet separating means for selectively feeding the respective uppermost sheet of the first sheet pile to the sheet treating machine, a second sheet pile carried by an auxiliary pile table, a second sheet separating means for selectively feeding the respective upper sheets of the second sheet pile in place of the sheets of the first sheet pile to the sheet treating machine, wherein the improvement comprises means for feeding the sheets to the sheet treating machine from the main pile table and the auxiliary pile table in the same rhythm, whereby on change of sheet feed from one to the other sheet pile, the sheet stream from the sheet pile, from which the sheet feeding was taking place, is interrupted in such a way and the sheet flow from the other sheet pile is put into operation in such a way that the sheet feed to the sheet treating machine is without interruption, and wherein the sheet feed takes place with an underlapped sheet stream, wherein the first sheet of the lapped stream of sheets from the first sheet pile can be slid under the last sheet of the lapped sheet stream from the second sheet pile.

2. The sheet feeder as claimed in claim 1, further comprising a presetting device for selecting the number of sheets in said sheet feed, up to a change from the feeding of the sheets from the auxiliary pile table to the sheets from the main pile table.

3. The sheet feeder as claimed in claim 2, wherein the presetting device is a preset counter of an operation control circuit for the sheet feeder.

4. The sheet feeder as claimed in claim 1, further comprising an operation control circuit including means for initiating the operational running of the sheet feeder.

5. The sheet feeder as claimed in claim 1, further comprising means for selectively engaging a mechanical drive connection between the sheet treating machine and the first sheet separation means.

6. The sheet feeder as claimed in claim 5, further comprising means for selectively engaging a second mechanical drive connection between the first and the second sheet separation means.

7. The sheet feeder as claimed in claim 6, further comprising means for simultaneously making the first and second drive connections.

8. The sheet feeder as claimed in claim 6, further comprising an operation control circuit including a common circuit for simultaneously making the drive connections.

9. The sheet feeder as claimed in claim 6, and including means for disengaging the mechanical drive connection between the first and second sheet separating means after feed of the last of a preselected number of sheets to the sheet treating machine.

10. The sheet feeder as claimed in claim 1, further comprising an operation control circuit including a first adjustable preselector device for selecting the number of sheets in said sheet feed up to a change from the feeding of the sheets from the auxiliary pile table to the sheets from the main pile table, and a second adjustable preselector device for selecting the number of sheets in said sheet feed after a change from the feeding of the sheets from the main pile table to the sheets from the auxiliary pile table.

11. The sheet feeder as claimed in claim 10, wherein the preselector devices are preset counters.

12. The sheet feeder as claimed in claim 1, wherein the main pile table and the auxiliary pile table are fixedly arranged one above the other.

13. The sheet feeder as claimed in claim 12, further comprising first and second feed tables arranged one above the other for guiding the feeding of sheets by the first and second sheet separating means, respectively, from the respective pile table to the sheet treating machine.

14. The sheet feeder as claimed in claim 13, where the ends of the first and second feed tables adjacent to the sheet treating machine are arranged in substantially the same run-in position relative to the sheet treating machine.

15. The sheet feeder as claimed in claim 13, wherein the ends of the first and second feed tables towards the sheet treating machine are spaced from one another at a slightly greater distance than the thickness of a lapped sheet stream.

16. The sheet feeder as claimed in claim 13, further comprising means for swinging the end of the upper feed table adjacent to the sheet treating machine upwardly away from the end of the lower feed table adjacent to the sheet treating machine.

17. The sheet feeder as claimed in claim 1, further comprising at least one electric motor to raise the main pile table to maintain a constant height for the uppermost sheet on the first sheet pile.

18. The sheet feeder as claimed in claim 1, where the first sheet separating means has a suction head arranged to grasp the uppermost sheet on the first sheet pile and move it in the feed direction.

19. The sheet feeder as claimed in claim 1, further comprising a sheet feed table for guiding the feeding of sheets by the first sheet separating means from the main pile table to the sheet treating machine, including a multiple sheet checking device in the sheet transport region of the sheet feed table.

* * * * *